US008573716B2

(12) United States Patent
Zalewski

(10) Patent No.: US 8,573,716 B2
(45) **Date of Patent: *Nov. 5, 2013**

(54) STORAGE AND ORGANIZATION SYSTEM AND CONNECTIVITY OF THE COMPONENTS THEREIN

(75) Inventor: Kevin Zalewski, Rochester Hills, MI (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/481,428

(22) Filed: May 25, 2012

(65) Prior Publication Data

US 2012/0229006 A1 Sep. 13, 2012

Related U.S. Application Data

(63) Continuation of application No. 12/554,034, filed on Sep. 4, 2009, now Pat. No. 8,186,776.

(60) Provisional application No. 61/160,977, filed on Mar. 17, 2009.

(51) Int. Cl.
*F16B 12/00* (2006.01)

(52) U.S. Cl.
USPC ..... 312/111; 312/107

(58) Field of Classification Search
USPC ..... 312/107, 108, 111, 257.1, 263, 265.5
See application file for complete search history.

(56) References Cited

U.S. PATENT DOCUMENTS

| | | | |
|---|---|---|---|
| 1,076,116 | A | 10/1913 | Hatfield |
| 1,694,487 | A | 12/1928 | Ringer |
| 1,799,831 | A | 5/1929 | Pauls |
| 2,121,190 | A | 6/1938 | Fellowes |

(Continued)

FOREIGN PATENT DOCUMENTS

| | | | |
|---|---|---|---|
| AU | B69962191 | | 10/1991 |
| DE | 3020836 | A | 12/1981 |

(Continued)

OTHER PUBLICATIONS

"iCube, my cube, my spaceTM", materials publicly provided in an offer to sell the associated product at least as early as Apr. 23, 2008, 22 pages.

(Continued)

*Primary Examiner* — Darnell Jayne
*Assistant Examiner* — Ryan A Doyle
(74) *Attorney, Agent, or Firm* — Griffiths & Seaton PLLC; JoAnn M. Seaton

(57) ABSTRACT

A storage shell includes a plurality of sidewalls to collectively define a chamber therebetween. A first sidewall defines a panel and a track. The panel defines an outer perimeter edge, an exterior surface, and holes extending through the panel. The track is coupled to the panel and includes a first rib and a second rib each extending from the exterior surface. The first rib is positioned inside the outer perimeter edge. The second rib is concentric with and shaped similarly to the first rib. The first rib and the second rib each separately border each one of the holes where each of the holes is formed between the first rib and the second rib. Related storage and organization systems, accessories and methods are also disclosed and provide additional advantages.

17 Claims, 13 Drawing Sheets

(56) References Cited

U.S. PATENT DOCUMENTS

| | | | | |
|---|---|---|---|---|
| 2,257,536 | A | 9/1941 | Roycroft | |
| 2,299,766 | A | 10/1942 | Rosenthal | |
| 2,364,083 | A | 12/1944 | Lindsay | |
| 2,663,449 | A | 12/1953 | Smart | |
| 2,697,631 | A | 12/1954 | Miller | |
| 3,027,045 | A | 5/1961 | Wilson | |
| 3,117,692 | A | 1/1964 | Carpenter et al. | |
| 3,170,594 | A | 2/1965 | Nascher | |
| 3,254,440 | A | 6/1966 | Duggar | |
| 3,254,786 | A | 6/1966 | Melville | |
| 3,279,873 | A | 10/1966 | Gronquist | |
| 3,421,656 | A | 2/1968 | Asenbauer | |
| 3,468,591 | A | 9/1969 | Wodli | |
| 3,506,321 | A | 4/1970 | Hampel | |
| 3,552,579 | A | 1/1971 | Simon et al. | |
| 3,563,624 | A * | 2/1971 | Stice | 312/111 |
| 3,583,780 | A | 6/1971 | Berkowitz | |
| 3,655,065 | A | 4/1972 | Yellin | |
| 3,661,434 | A | 5/1972 | Alster | |
| 3,722,704 | A | 3/1973 | Piretti | |
| 3,722,971 | A | 3/1973 | Zeischegg | |
| 3,743,372 | A | 7/1973 | Ruggerone | |
| 3,822,924 | A * | 7/1974 | Lust | 312/111 |
| 3,836,217 | A | 9/1974 | Shiina | |
| 3,836,218 | A | 9/1974 | Hallal | |
| 3,853,367 | A | 12/1974 | Jamison et al. | |
| 3,856,147 | A | 12/1974 | Piretti | |
| 3,874,753 | A | 4/1975 | Naito et al. | |
| 3,885,845 | A | 5/1975 | Krieks | |
| 3,975,877 | A | 8/1976 | Walton | |
| 4,047,773 | A | 9/1977 | Semany | |
| 4,050,604 | A | 9/1977 | Flanders | |
| 4,192,562 | A | 3/1980 | Bishoff et al. | |
| 4,196,948 | A | 4/1980 | Gavel et al. | |
| 4,261,627 | A | 4/1981 | Felsenthal | |
| 4,403,554 | A | 9/1983 | Valentine et al. | |
| 4,448,463 | A | 5/1984 | Amos | |
| 4,470,647 | A | 9/1984 | Bishoff et al. | |
| 4,593,816 | A | 6/1986 | Langenbeck | |
| 4,704,313 | A | 11/1987 | Maier | |
| 4,707,038 | A | 11/1987 | Voegeli | |
| 4,717,214 | A | 1/1988 | Moore et al. | |
| 4,742,931 | A | 5/1988 | Bennett | |
| 4,782,637 | A | 11/1988 | Eriksson et al. | |
| 4,863,222 | A | 9/1989 | Posso | |
| 4,903,451 | A * | 2/1990 | Gresswell | 52/584.1 |
| 5,119,610 | A | 6/1992 | Birkeland et al. | |
| 5,147,120 | A | 9/1992 | Ray | |
| 5,176,435 | A | 1/1993 | Pipkens | |
| 5,356,031 | A | 10/1994 | Jondelius | |
| 5,357,728 | A | 10/1994 | Duncanson | |
| 5,360,263 | A * | 11/1994 | Nakano et al. | 312/257.1 |
| D361,203 | S | 8/1995 | Regnier | |
| 5,464,295 | A | 11/1995 | Daillot | |
| 5,466,058 | A * | 11/1995 | Chan | 312/111 |
| 5,497,888 | A | 3/1996 | Michaels et al. | |
| 5,562,224 | A | 10/1996 | Pascal et al. | |
| 5,584,412 | A | 12/1996 | Wang | |
| 5,615,797 | A | 4/1997 | Ripamonti | |
| 5,664,856 | A | 9/1997 | Pacetti | |
| 5,680,744 | A | 10/1997 | Kramedjian et al. | |
| 5,699,925 | A | 12/1997 | Petruzzi | |
| 5,720,547 | A | 2/1998 | Baird | |
| D396,566 | S * | 8/1998 | Albrecht | D6/349 |
| 5,888,114 | A | 3/1999 | Slocum et al. | |
| 5,902,025 | A | 5/1999 | Yu | |
| 5,913,580 | A | 6/1999 | Liu | |
| 5,941,616 | A | 8/1999 | Billingham | |
| 6,024,626 | A | 2/2000 | Mendelsohn | |
| 6,039,202 | A | 3/2000 | Olstad et al. | |
| D437,706 | S | 2/2001 | Alcala et al. | |
| 6,193,340 | B1 * | 2/2001 | Schenker et al. | 312/265.5 |
| 6,209,976 | B1 | 4/2001 | Shear | |
| D454,454 | S | 3/2002 | Hamilton et al. | |
| 6,352,323 | B1 | 3/2002 | Rives | |
| D455,292 | S | 4/2002 | Hardy et al. | |
| 6,536,856 | B2 | 3/2003 | Pelizzari et al. | |
| 6,698,853 | B2 | 3/2004 | Chen et al. | |
| 6,722,515 | B2 * | 4/2004 | Rumpel | 220/6 |
| 6,820,950 | B1 | 11/2004 | Sun | |
| 6,942,306 | B2 | 9/2005 | Youngs et al. | |
| 6,962,262 | B2 | 11/2005 | Toma | |
| 6,966,450 | B2 | 11/2005 | Askew | |
| 6,971,529 | B1 | 12/2005 | Shapiro | |
| 7,261,219 | B2 | 8/2007 | Tucker et al. | |
| 7,472,969 | B2 | 1/2009 | Saravis | |
| 7,507,136 | B2 | 3/2009 | Patton | |
| D592,402 | S | 5/2009 | Ahlgrim et al. | |
| D594,657 | S | 6/2009 | McAlpine | |
| D596,857 | S | 7/2009 | Ahlgrim et al. | |
| 7,588,162 | B2 | 9/2009 | Dube et al. | |
| D602,255 | S | 10/2009 | Ahlgrim et al. | |
| 7,621,421 | B2 | 11/2009 | Ohayon | |
| D605,896 | S | 12/2009 | Zalewski et al. | |
| D617,582 | S | 6/2010 | Zalewski | |
| D619,829 | S | 7/2010 | Zalewski et al. | |
| D619,832 | S | 7/2010 | Zalewski et al. | |
| D622,959 | S | 9/2010 | Zalewski et al. | |
| 7,866,769 | B2 | 1/2011 | Ahlgrim et al. | |
| D632,892 | S | 2/2011 | Zalewski et al. | |
| D634,567 | S | 3/2011 | Zalewski | |
| 7,984,820 | B2 | 7/2011 | Dancyger | |
| 8,113,600 | B2 * | 2/2012 | Zalewski et al. | 312/111 |
| 8,186,776 | B2 * | 5/2012 | Zalewski | 312/111 |
| 2002/0093272 | A1 | 7/2002 | Saravis | |
| 2002/0109442 | A1 * | 8/2002 | Hsu | 312/263 |
| 2002/0125799 | A1 * | 9/2002 | Landsberger et al. | 312/209 |
| 2002/0185941 | A1 | 12/2002 | Ferraro et al. | |
| 2003/0184199 | A1 | 10/2003 | Jananji | |
| 2003/0193274 | A1 | 10/2003 | Saravis | |
| 2003/0222545 | A1 | 12/2003 | Stravitz | |
| 2004/0164653 | A1 | 8/2004 | Winkless | |
| 2004/0217677 | A1 | 11/2004 | Durand et al. | |
| 2005/0006991 | A1 | 1/2005 | Saravis | |
| 2005/0077805 | A1 | 4/2005 | Dalebout et al. | |
| 2005/0088068 | A1 | 4/2005 | Chang | |
| 2005/0104483 | A1 | 5/2005 | Saravis | |
| 2005/0104484 | A1 * | 5/2005 | Landsberger et al. | 312/194 |
| 2005/0168116 | A1 | 8/2005 | Chuang | |
| 2005/0191611 | A1 | 9/2005 | Owen et al. | |
| 2005/0264147 | A1 | 12/2005 | Norris et al. | |
| 2006/0080928 | A1 | 4/2006 | Kichijo et al. | |
| 2006/0244348 | A1 | 11/2006 | Richied et al. | |
| 2006/0250052 | A1 * | 11/2006 | Davis et al. | 312/107 |
| 2007/0158347 | A1 * | 7/2007 | Ohayon | 220/23.6 |
| 2008/0011697 | A1 | 1/2008 | Berg | |
| 2008/0017596 | A1 | 1/2008 | Brock | |
| 2008/0074013 | A1 * | 3/2008 | Ahlgrim et al. | 312/108 |
| 2008/0128428 | A1 | 6/2008 | Beckerman | |
| 2008/0258593 | A1 | 10/2008 | Berger | |
| 2008/0290771 | A1 * | 11/2008 | Jimenez | 312/263 |
| 2010/0019630 | A1 * | 1/2010 | Leng | 312/107 |
| 2010/0237755 | A1 | 9/2010 | Zalewski | |
| 2011/0074255 | A1 | 3/2011 | Ahlgrim et al. | |
| 2012/0242200 | A1 * | 9/2012 | Keragala | 312/111 |

FOREIGN PATENT DOCUMENTS

| | | | |
|---|---|---|---|
| DE | 3302105 | | 7/1983 |
| DE | 3933611 | | 4/1991 |
| DE | 4313330 | | 9/1994 |
| DE | 19735185 | | 2/1999 |
| DE | 19949849 | | 2/2001 |
| DE | 20309712 | U | 8/2003 |
| EP | 0270495 | | 6/1988 |
| EP | 0614017 | | 9/1994 |
| EP | 0801912 | | 10/1997 |
| FR | 2316679 | | 1/1977 |
| FR | 2376677 | | 8/1978 |
| FR | 2862356 | | 5/2005 |
| GB | 2101202 | A | 1/1983 |
| GB | 2206280 | | 1/1989 |
| GB | 2231820 | A | 11/1990 |
| GB | 2355672 | | 5/2001 |

(56) References Cited

FOREIGN PATENT DOCUMENTS

| | | |
|---|---|---|
| GB | 2370239 A | 6/2002 |
| WO | 8700406 | 1/1987 |
| WO | 9920153 | 4/1999 |
| WO | 0127395 | 4/2001 |

OTHER PUBLICATIONS

Egan Visual, Inc., "Modeular Storage...configured to your requirements," 2004, 2 pages.
Egan Visual inc., "Finish Schedule," Price and Specification Guide, Jul. 2002, 11 pages.
Egan Visual, Inc., "Finish Schedule," Price and Specification Guide, Jul. 2002, 3 pages.
Egan Visual, Inc., "Mobile Task Carts & Lockers—Product Design Rationale," 2004, 2 pages.
Moduline Modular Aluminum Cabinets, "Moduline Pro-Series Combinations—Trailer Cabinets Organize With Style! —Modular Aluminum Storage Cabinets," printed from www.modulinecabinets.com in May 2006, 3 pages.
"elfa Platinum Garage System," printed from www.organize.com in May 2006, 2 pages.
"The Cube Storage System," printed from www.organize.com in May 2006, 2 pages.
"Storage Cubes: a Unique 5 Piece Modular Storage System—Cherry," printed from www.organize.com in May 2006, 2 pages.
"elfa basic 9' Double Hang Closet," printed from www.organize.com in May 2006, 2 pages.
"Closits Modular Furniture System—Maple," printed from www.target.com in May 2006, 3 pages.
"QBO Storage Soluation," www.topdeq.com/topdeq/product.do@catid=us_75&prodid=pp_QBO, printed May 2006, 2 pages.
"Cubo Modular Storage," www.topdeq.com/topdeq/product.do@catid=us_75&prodid=pp_QBO, printed May 2006, 3 pages.
Storage Member publicly available in IKEA stores at least as early as Jan. 2000.
Shopwiki, "Oraganizer Bins-Lookers-Locker Organizers-Magnetic Storage bins," http://www.shopwiki.com/_Organizer+Bins+-+Locker+Organizers+-+Magnetic+Storage_Bins, printed on Aug. 2, 2009, 2 pages.

* cited by examiner

STORAGE AND ORGANIZATION SYSTEM AND CONNECTIVITY OF THE COMPONENTS THEREIN

CROSS-REFERENCE TO RELATED APPLICATIONS

The present application is a continuation application of and claims priority to U.S. patent application Ser. No. 12/554,034, filed Sep. 4, 2009, now U.S. Pat. No. 8,186,776, issued May 29, 2012, which is a non-provisional application of and claims priority to U.S. Provisional Application No. 61/160,977, filed on Mar. 17, 2009, now expired, both of which are incorporated herein.

This application is also related to the following applications:

U.S. patent application Ser. No. 11/851,165, filed Sep. 6, 2007, now U.S. Pat. No. 7,866,769, issued Jan. 11, 2011, which claims priority to now expired U.S. Provisional Application No. 60/941,503, filed Jun. 1, 2007, and now expired U.S. Provisional Application No. 60/842,469, filed Sep. 6, 2006;

U.S. patent application Ser. No. 12/960,242, filed Dec. 4, 2012 as a divisional application of U.S. patent application Ser. No. 11/851,165;

U.S. patent application Ser. No. 29/284,375, filed Sep. 6, 2007, now U.S. Pat. No. D602,255, issued Oct. 20, 2009;

U.S. patent application Ser. No. 29/329,629, filed Dec. 18, 2008, now U.S. Pat. No. D596,857, issued Jul. 28, 2009, which is a divisional application of U.S. Design application No. 29/284,375;

U.S. patent application Ser. No. 29/284,379, filed Sep. 6, 2007, now U.S. Pat. No. D592,402;

U.S. patent application Ser. No. 12/554,028, filed Sep. 4, 2009, now U.S. Pat. No. 8,113,600, issued Feb. 14, 2012, which claims priority to now expired U.S. Provisional Application No. 61/161,019, filed on Mar. 17, 2009;

U.S. patent application Ser. No. 13/372,064, filed Feb. 13, 2012 as a continuation application of U.S. patent application Ser. No. 12/554,028;

U.S. patent application Ser. No. 29/333,915, filed on Mar. 17, 2009, now U.S. Pat. No. D622,959, issued Sep. 7, 2012;

U.S. patent application Ser. No. 29/368,567, filed on Aug. 25, 2010 as a divisional application of U.S. patent application Ser. No. 29/333,915, now U.S. Pat. No. D632,892, issued Feb. 22, 2011;

U.S. patent application Ser. No. 29/378,520, filed on Nov. 5, 2010 as a divisional application of U.S. patent application Ser. No. 29/368,567, now U.S. Pat. No. D663,118, issued Jul. 10, 2012;

U.S. patent application Ser. No. 29/333,917, filed on Mar. 17, 2009, now U.S. Pat. No. D617,582; and U.S. patent application Ser. No. 29/361,912, filed on May 17, 2010 as a divisional application of U.S. Patent application No. 29/333,917, now U.S. Pat. No. D634,567; all of which are incorporated herein by reference.

BACKGROUND OF THE INVENTION

Many organization and storage items and systems are available to assist consumers in storing and organizing their belongings. However, in general, consumers continually accumulate items and/or transfer items from one location in a home to another. Accordingly, a storage and organization system that may function well for a consumer at one point in time may gradually become ill suited for the consumer's needs at a subsequent time. In order to adapt to their changing needs, consumers often discard and replace old organization systems with new, more suitable systems. In this manner, as the needs of a consumer continue to evolve, a cycle of implementing and replacing organization systems often occurs. This cycle, which may seem to be never ending, can leave a consumer frustrated and distraught with attempts to organize the typically increasing inventory of belongings according to the consumer's evolving use of such belongings.

SUMMARY OF THE INVENTION

One aspect of the present invention relates to a storage shell including a plurality of sidewalls collectively defining a chamber therebetween. A first sidewall defines a panel and a track. The panel defines an outer perimeter edge, an exterior surface, and holes extending through the panel. The track is coupled to the panel and includes a first rib and a second rib each extending from the exterior surface. The first rib is positioned inside the outer perimeter edge. The second rib is concentric with and shaped similarly to the first rib. The first rib and the second rib each separately border each one of the holes where each of the holes is formed between the first rib and the second rib. Related products, systems, components and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A storage and organization system according to the embodiments described herein is configured to store a plurality of goods, such as a consumer's belongings, and to be easily reconfigured to evolve with the changing needs of the consumer. In one example, the system described herein is configured to be assembled without permanency while still providing a sturdy and aesthetically pleasing storage assembly. In one embodiment, although the general components of the system are configured for a plurality of purposes, additional accessory and other components are provided and configured to interface with the general components to personalize the system for use in a particular area of the home, at a particular time in a consumer's life, etc., based on the needs of the consumer. As such, in one example, the storage and organization system is an adaptable, aesthetically pleasing alternative to the plurality of mismatched organizational units generally available in the prior art.

Figure 9:
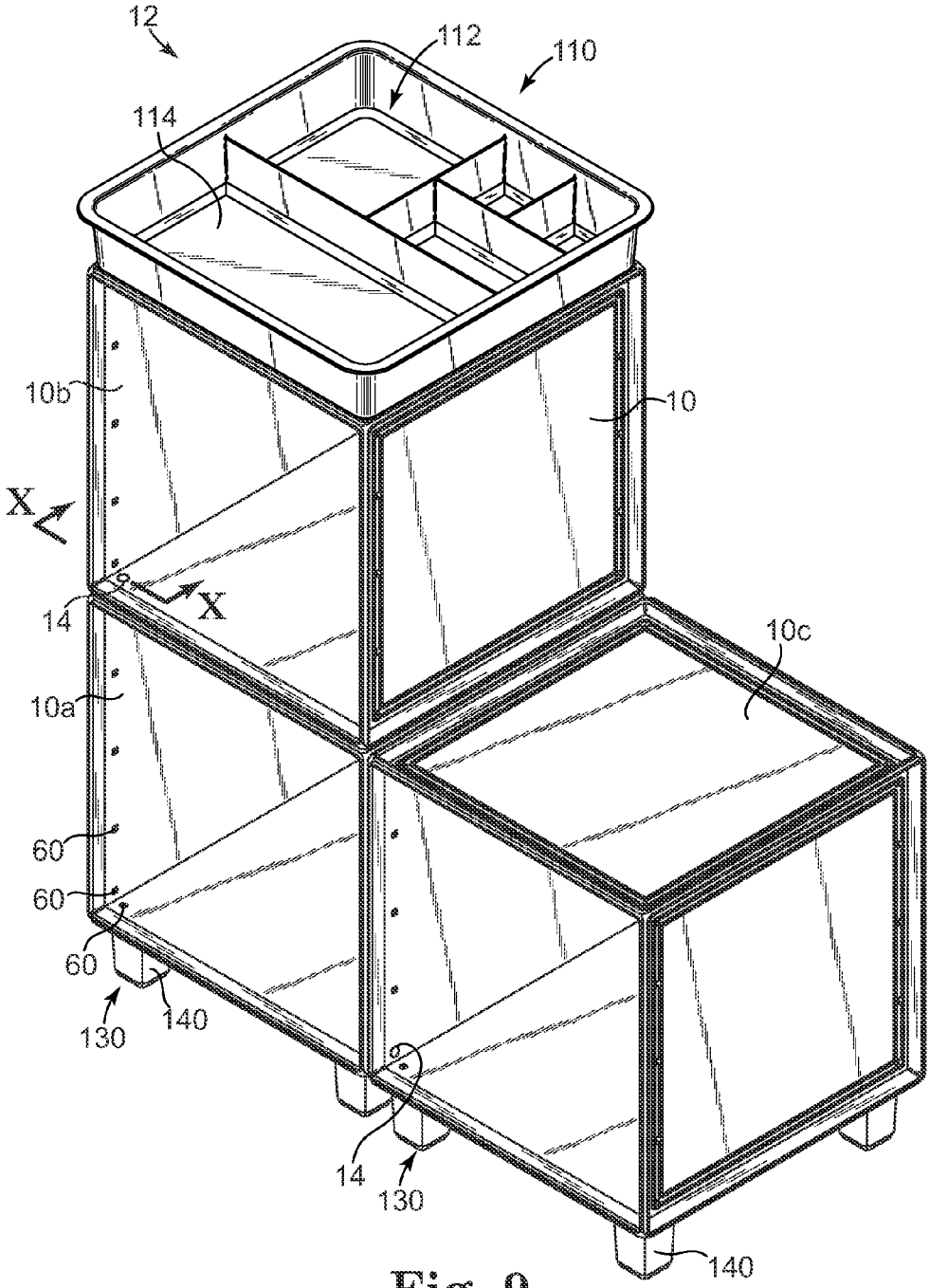
FIG. 9 illustrates a storage and organization system including the storage shell of FIG. 1, according to one embodiment of the present invention.
Figure 10:
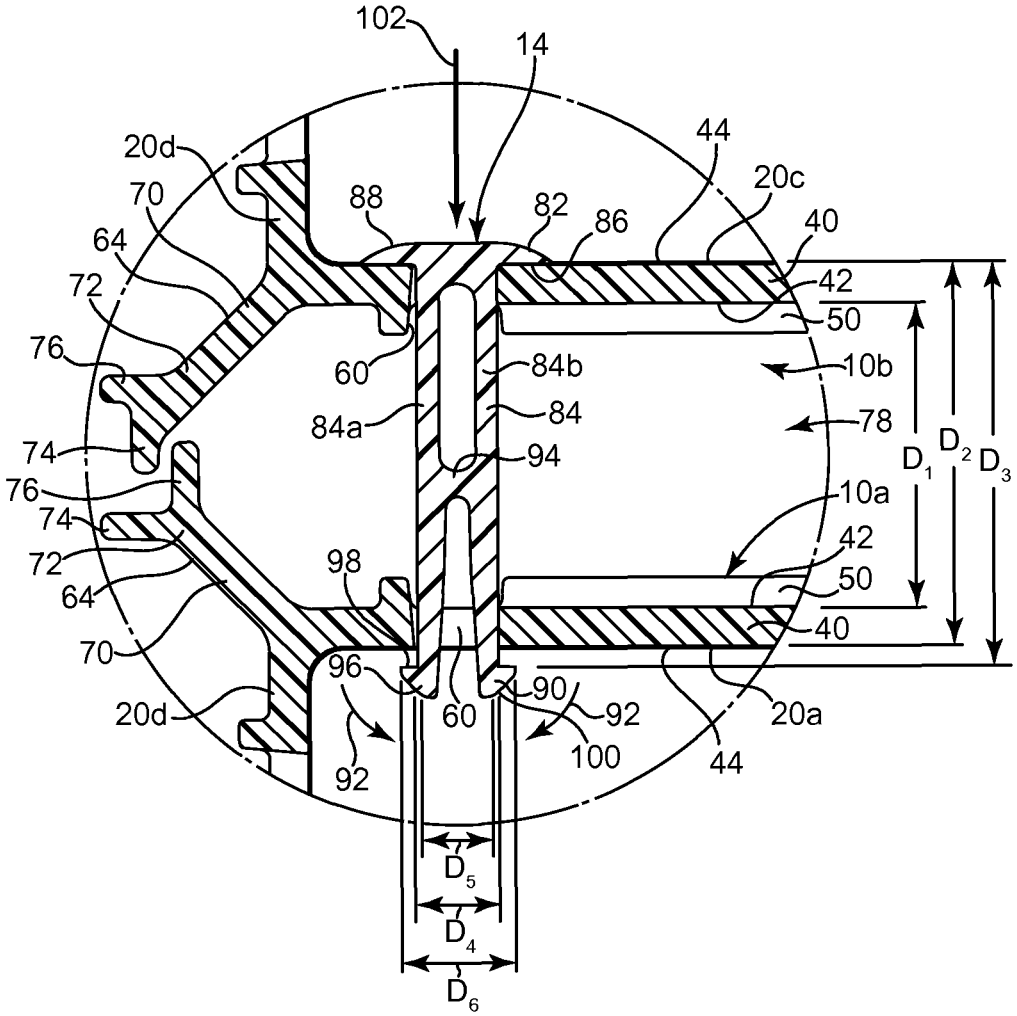
FIG. 10 illustrates a cross-sectional view as indicated by the line X-X in FIG. 9, according to one embodiment of the present invention.

Turning to the figures, FIGS. 1-8 each generally illustrate storage shell 10 (e.g., a storage box) or at least a portion thereof according to one embodiment of the present invention. Storage shell 10 serves as a basic building block of a storage and organization system 12 (for example, as illustrated in FIG. 9). Storage shells 10 are configured to be substantially modular and readily couplable and repositionable relative to one another without causing damage to any storage shell 10. In one embodiment, storage shells 10 are configured to be selectively coupled to one another using repositionable and reversible clips 14 (e.g., as illustrated in FIGS. 9 and 10), which will be further described below.

In one embodiment, each storage shell 10 defines four sidewalls 20*a*, 20*b*, 20*c*, and 20*d* (collectively referred to as sidewalls 20) and a rear wall 22. Each sidewall 20 is substantially rectangular (e.g., square) and extends between opposite edges of two other sidewalls 20 to define a rectangular box-like structure. Rear wall 22 is coupled to a rear edge 24 of each sidewall 20 such that a compartment 26 (e.g., a cavity, chamber, or void) is defined by storage shell 10 between sidewalls 20 and rear wall 22. A front opening 28 to compartment 26 is defined opposite rear wall 22 and is bordered by a front edge 30 of each of the sidewalls 20 opposite rear edges 24. As such, in one embodiment, storage shell 10 is essentially formed as a parallelepiped with an open face (i.e., front opening 28) opposite rear wall 22. In one embodiment, each storage shell 10 is formed from a single material, for example, a suitable plastic material or similar material injection or otherwise molded to form storage shell 10.

Figure 1:
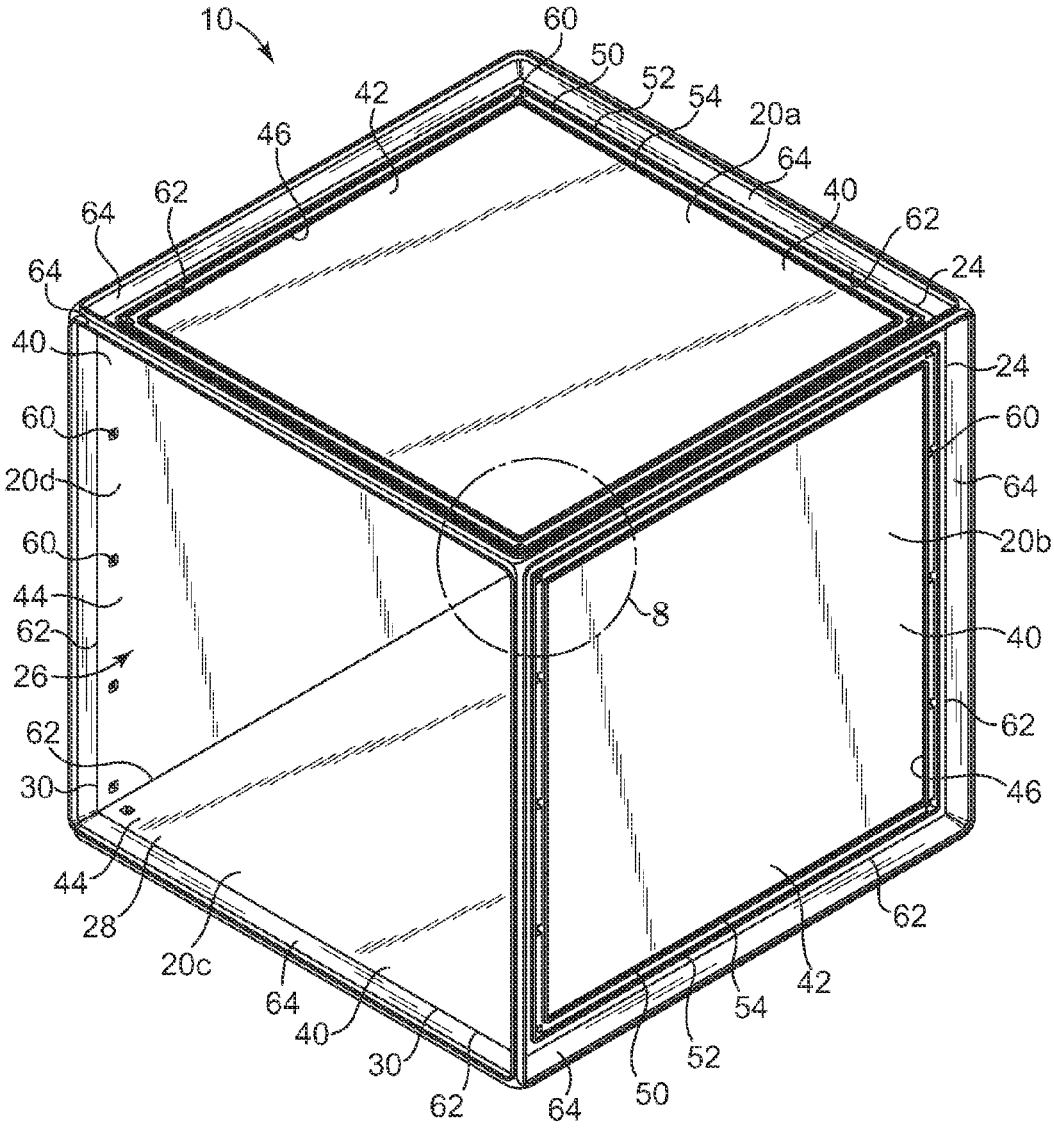
FIG. 1 illustrates a perspective view of a storage shell, according to one embodiment of the present invention.
Figure 2:
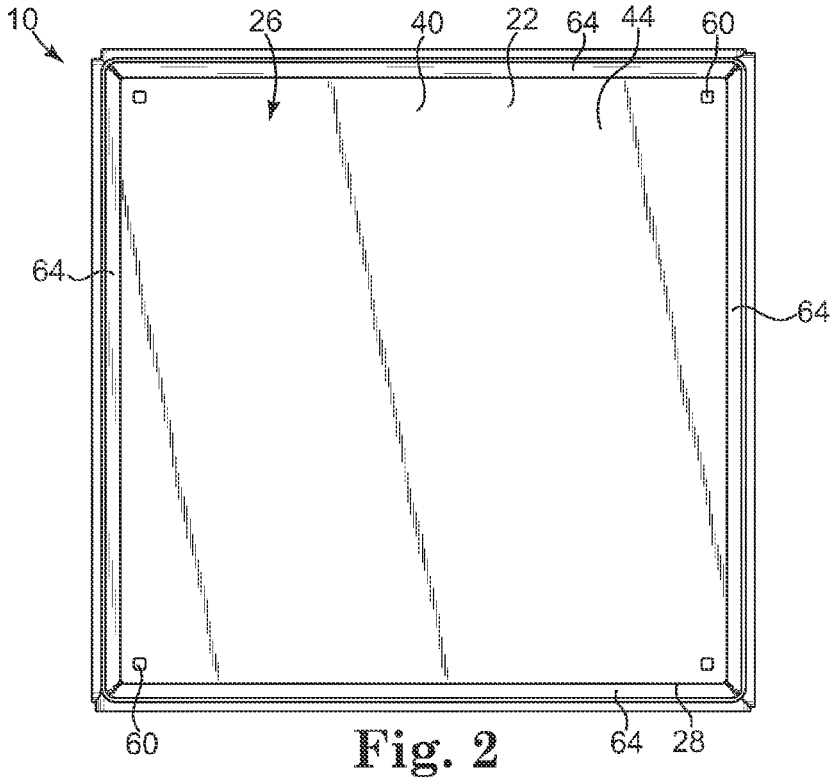
FIG. 2 illustrates a front view of the storage shell of FIG. 1, according to one embodiment of the present invention.
Figure 3:
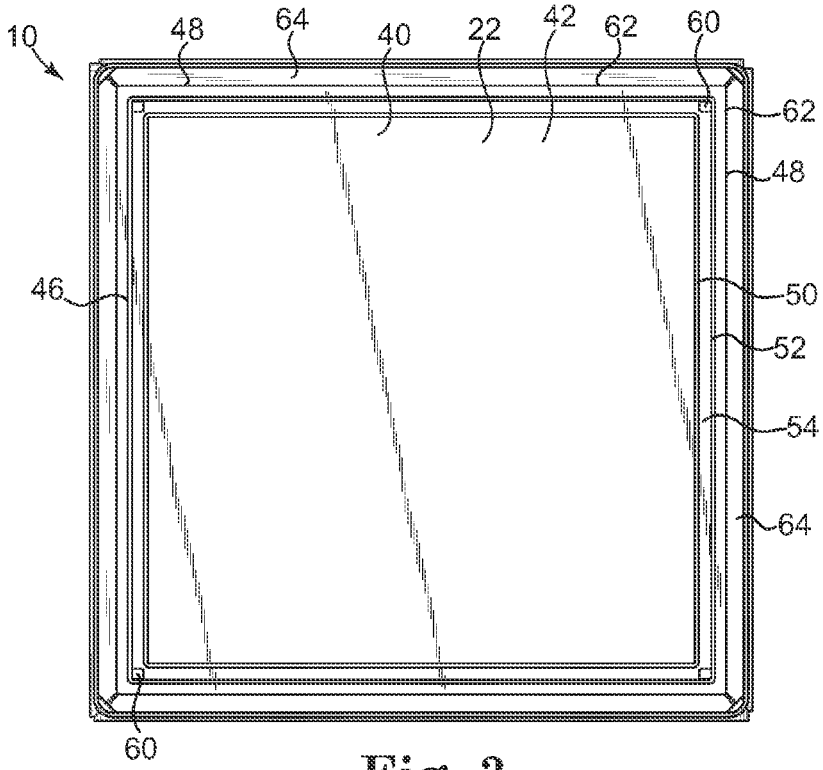
FIG. 3 illustrates a rear view of the storage shell of FIG. 1, according to one embodiment of the present invention.
Figure 4:
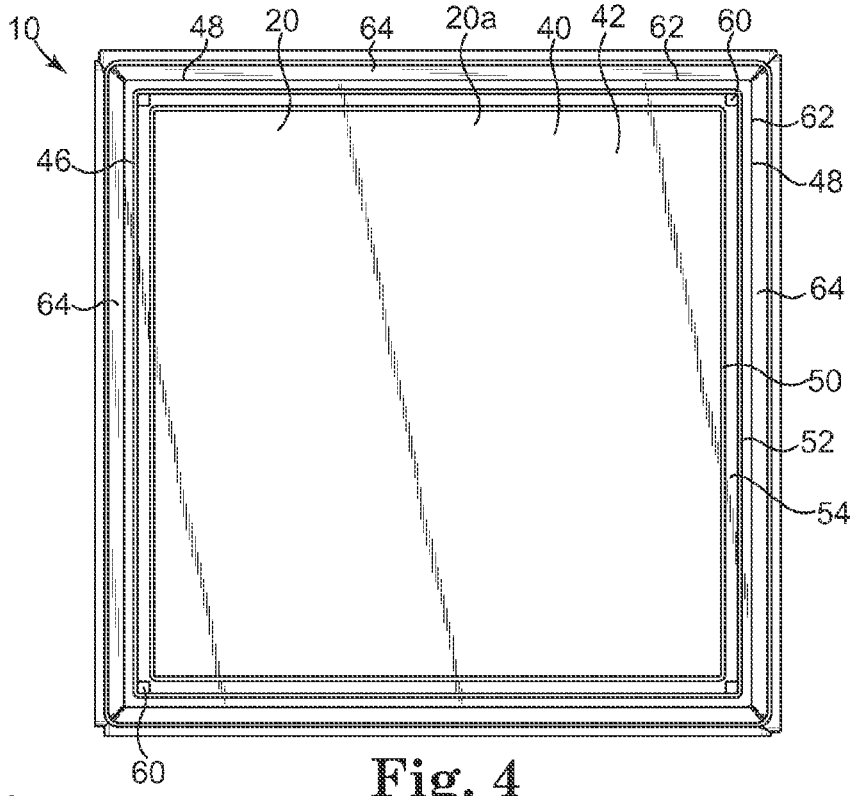
FIG. 4 illustrates a top view of the storage shell of FIG. 1, according to one embodiment of the present invention.
Figure 5:
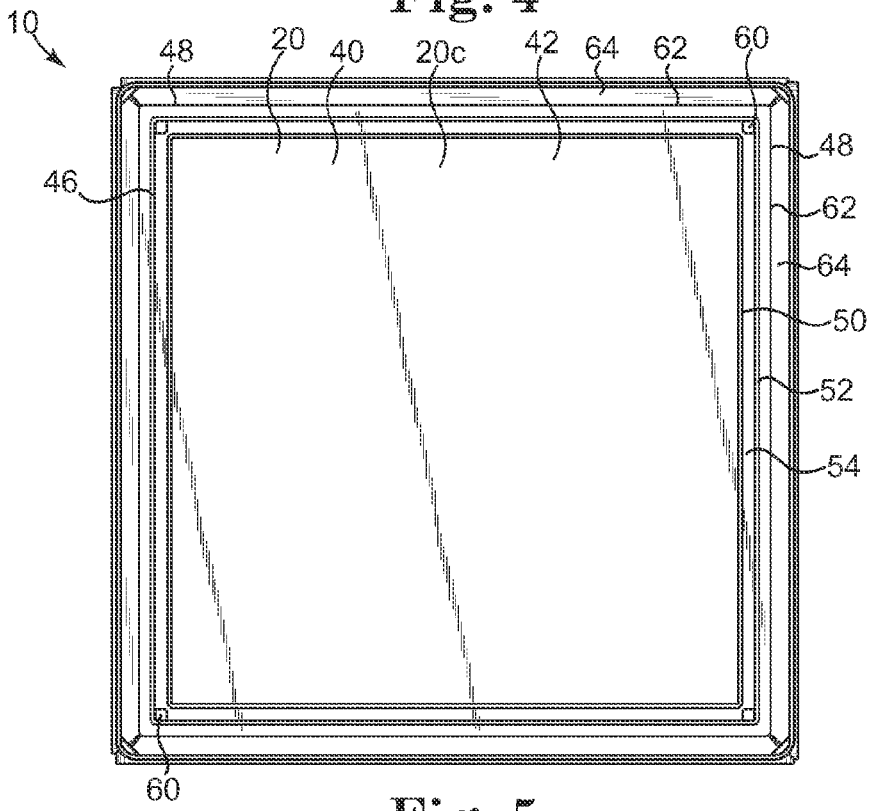
FIG. 5 illustrates a bottom view of the storage shell of FIG. 1, according to one embodiment of the present invention.
Figure 6:
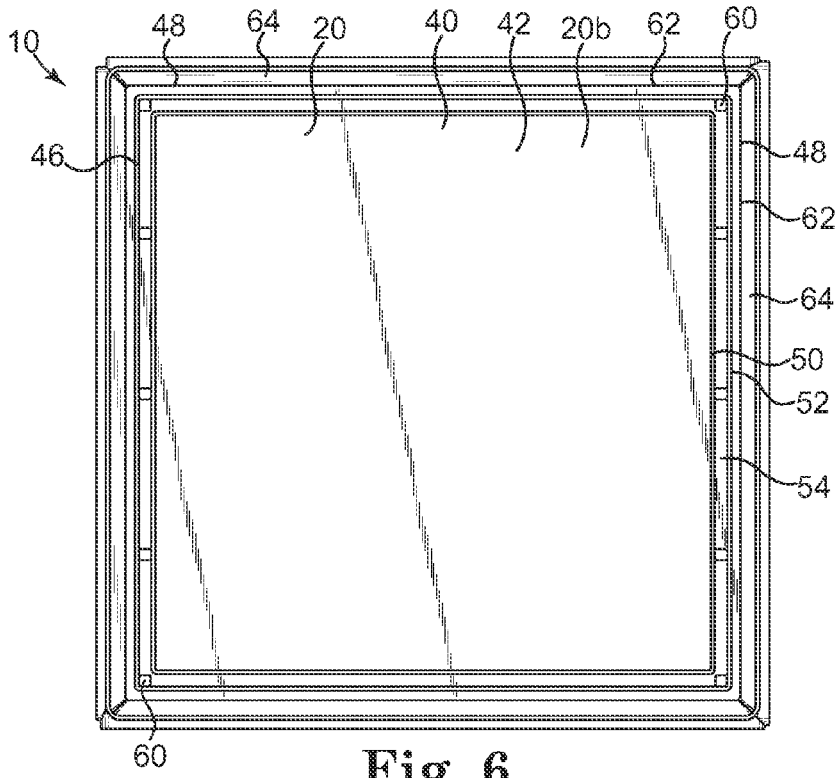
FIG. 6 illustrates a right side view of the storage shell of FIG. 1, according to one embodiment of the present invention.
Figure 7:
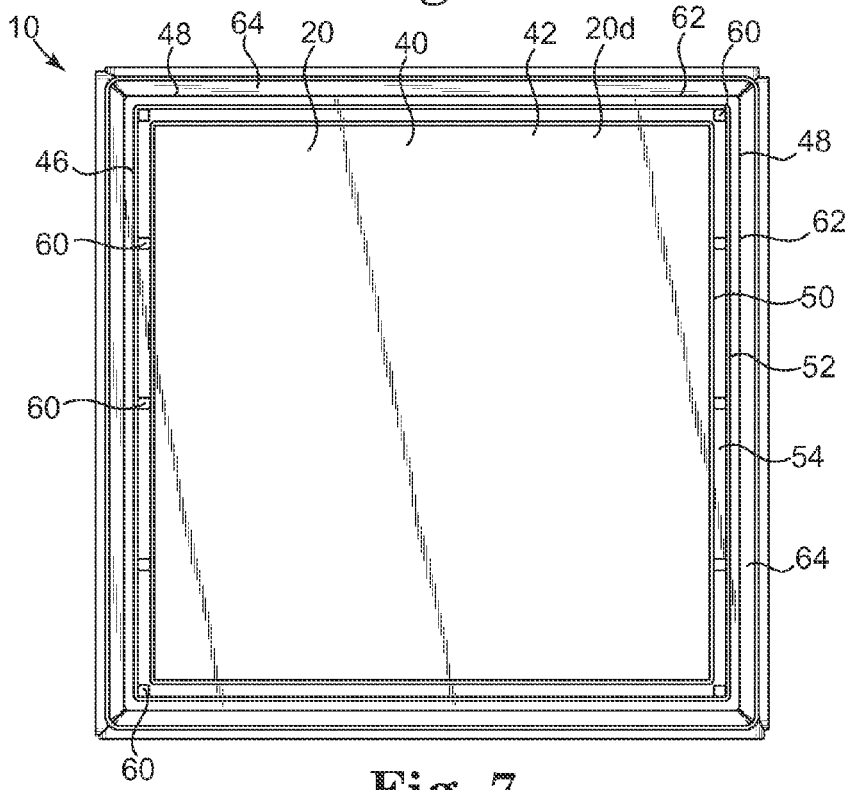
FIG. 7 illustrates a left side view of the storage shell of FIG. 1, according to one embodiment of the present invention.
Figure 8:
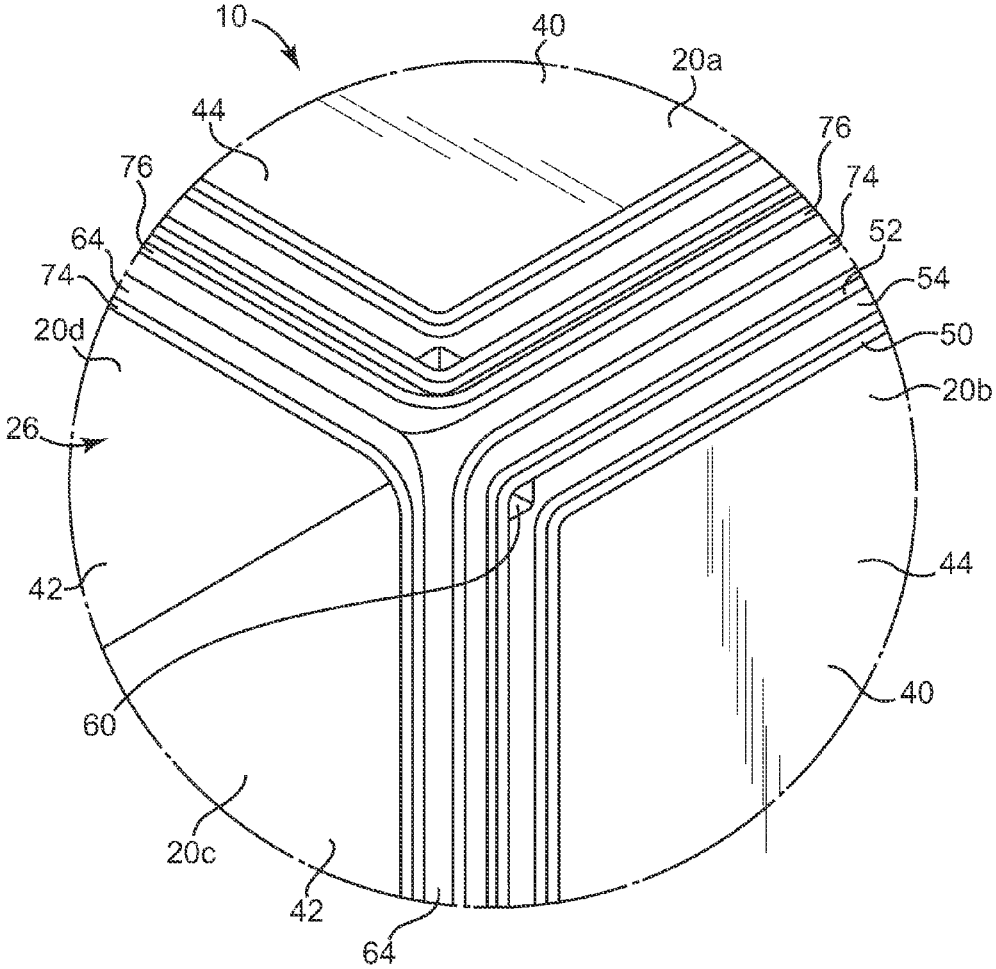
FIG. 8 illustrates a detail view of a portion of the storage shell as indicated in FIG. 1, according to one embodiment of the present invention.

Referring to FIG. 1, in one embodiment, each sidewall 20 includes a substantially planar panel 40 in a square or other rectangular shape defining an exterior surface 42 and an interior surface 44 opposite exterior surface 42. In one example, a separate track 46 extends outwardly (i.e., away from compartment 26) from exterior surface 42 of each substantially planar panel 40. Track 46, more specifically, extends around exterior surface 42 inset slightly from outer perimeter edges 48 of the corresponding substantially planar panel 40. As such, an outer perimeter of track 46 is shaped similarly to, but is slightly smaller than, an outer perimeter of a corresponding substantially planar panel 40.

In one example, track 46 includes a first or inner rib 50 and a second or outer rib 52. Inner rib 50 is positioned just inside and is concentric with outer rib 52. In one embodiment, inner rib 50 and outer rib 52 are each continuous and define four linear lengths in a generally square or otherwise rectangular manner. Track 46 defines an opening or groove 54 between inner rib 50 and outer rib 52. In one example, each of inner rib 50 and outer rib 52 and track 46 as a whole, provide additional rigidity and support to sidewalls 20. For instance, track 46 provides each substantially planar panel 40 with additional strength and decreases twisting, warping, or other deformations of substantially planar panel 40 when storage shell 10 is loaded with goods, etc. In one embodiment, use of track 46 allows substantially planar panel 40 to be formed thinner than if no track 46 were used as will be apparent to those of skill in the art upon reading the present application. Use of thinner walls decreases the amount of material needed to form each storage shell 10 and thereby reduces the cost of manufacturing the resultant storage shells 10.

In one example, one or more apertures or holes 60 extend through each sidewall 20, for example, in groove 54 of track 46. In one embodiment, each hole 60 is substantially square or otherwise rectangular in shape. In one embodiment, a hole 60 is defined in each of the four corners of track 46 in each of the four sidewalls 20 and rear wall 22. Additional holes 60 may be defined along one or more linear lengths of track 46. In one example, some sidewalls 20 include similar numbers and positioning of holes 60 while other sidewalls 20 and/or rear wall 22 may have different numbers and/or arrangements of holes 60. For example, top and bottom sidewalls 20*a* and 20*c*, which are positioned opposite and parallel to one another, only have holes 60 in the corners of the corresponding tracks 46. Vertical sidewalls 20*b* and 20*d*, which are positioned opposite and parallel to one another and perpendicular to top and bottom sidewalls 20*a* and 20*c*, include holes 60 in the corners of the corresponding tracks 46 and additionally each include a plurality of holes 60 linearly spaced at equal distances from one other along at least two of the linear lengths of each track 46. For example, vertical sidewalls 20*b* and 20*d* each have a plurality of holes 60 defined in portions of the groove 54 defined along the front and rear lengths (i.e., the vertical lengths) of the corresponding tracks 46.

An intersection line 62 is defined at the border between any one sidewall 20, rear wall 22, or front opening 28 and another sidewall 20, rear wall 22, or front opening 28. Accordingly, in one embodiment, twelve intersection lines 62 are formed by storage shell 10 including four around front opening 28, four around rear wall 22, and four extending front to back and being defined at the boundary between adjacent sidewalls 20. Additionally referring to the cross-sectional view of FIG. 10, in one embodiment, a flange 64 extends radially outwardly from one or more of the intersection lines 62, for example, from each intersection line 62, in a plane angled with respect to adjacent ones of sidewalls 20, rear wall 22, and front opening 28. As used herein, "radially" refers to a divergent extension of a member relative to a center of a corresponding storage shell 10 unless another reference is specifically provided. In one embodiment, each flange 64 radially extends from intersection line 62 at an angle between about 30° and about 60° as measured from each adjacent sidewall 20, rear wall 22, or front opening 30, for example, at an angle of about 45°.

In one embodiment, each flange 64 is substantially Y-shaped and includes a primary leg 70 extending from the corresponding intersection line 62 to define an outer end 72 opposite the corresponding intersection line 62. In one example, flange 64 additionally includes first and second auxiliary legs 74 and 76 extending substantially perpendicular to one another. In one embodiment, each of first and second auxiliary legs 74 and 76 extends from outer end 72 of primary leg 70 at an angle of between about 30° and about 60° from primary leg 70, for example, at an angle of about 45°. In one example, first and second auxiliary legs 74 and 76 each extend substantially parallel to at least one of sidewalls 20 and rear wall 22.

Referring to FIG. 9, multiple storage shells 10 are configured to be stacked and arranged to define a storage and organization system 12 in a modular manner. To facilitate a user in configuring the multiple storage shells 10, storage shells 10 are configured to be easily secured to one another without the use of tools other than connection clips 14 (e.g., connection devices). For example, two storage shells 10 may be stacked such that a bottom or first storage shell 10*a* supports a top or second storage shell 10*b*.

When shells 10 are stacked, two or more (e.g., all four) of flanges 64 adjacent top sidewall 20*a* of first storage shell 10*a* interact with two or more (e.g., all four) of flanges 64 adjacent bottom sidewall 20*c* of second storage shell 10*b*, for example, as illustrated in the cross-sectional view of FIG. 10. In one example, when the above-described flanges 64 interact, second auxiliary legs 76 of flanges 64 adjacent top sidewall 20*a* of first storage shell 10*a* are positioned adjacent and nest with first auxiliary legs 74 of flanges 64 adjacent bottom sidewall 20*c*. This nesting substantially maintains second storage shell 10*b* in place relative to first storage shell 10*a*, more particularly in place from side to side and from front to back of storage shells 10. For example, second auxiliary legs 76 of flanges 64 adjacent top sidewall 20*a* of first storage shell 10*a* extend just inside first auxiliary legs 74 of flanges 64 adjacent bottom sidewall 20*c*. In one embodiment, the opposite configuration of second auxiliary legs 76 of flanges 64 adjacent top sidewall 20*a* of first storage shell 10*a* and first auxiliary legs 74 of flanges 64 adjacent bottom sidewall 20*c* may be used as will be apparent to those of skill in the art upon reading this application.

Interaction between flanges 64 maintains top sidewall 20*a* of first storage shell 10*a* spaced from and positioned substantially parallel to bottom sidewall 20*c* of second storage shell 10*b*. For example, first auxiliary legs 74 of flanges 64 adjacent bottom sidewall 20*c* of second storage shell 10*b* rests on first auxiliary legs 74 of flanges 64 adjacent top sidewall 20*a* of first storage shell 10*a*. The above-described flange 64 interactions maintain top sidewall 20*a* of first storage shell 10*a* spaced from bottom sidewall 20*c* of second storage shell 10*b*. Notably, first auxiliary leg 74 of flanges 64 adjacent bottom sidewall 20*c* of second storage shell 10*b* are shown slightly spaced from first auxiliary leg 74 of flanges 64 adjacent top sidewall 20*a* of first storage shell 10*a*, in FIG. 10 for clarity of illustration as will be apparent to those of skill in the art upon reading the present application. When stacked, a cavity 78 is defined between bottom sidewall 20*c* of second storage shell 10*b* and top sidewall 20*a* of first storage shell 10*a*.

More specifically, a first distance $D_1$ (i.e., thickness of cavity 78) is defined between exterior surface 42 of bottom sidewall 20*c* of second storage shell 10*b* and exterior surface 42 of top sidewall 20*a* of first storage shell 10*a*. In one embodiment, distance $D_1$ is substantially larger than a total thickness of each sidewall 20 defined between the respective interior surface 44 and exterior surface 42 thereof. In one example, distance $D_1$ is at least four times larger than a total thickness of any one of sidewalls 20. A second distance $D_2$ is defined between interior surface 44 of bottom sidewall 20*c* of second storage shell 10*b* and interior surface 44 of top sidewall 20*a* of first storage shell 10*a*.

When first storage shell 10*a* and second storage shell 10*b* are stacked, holes 60 extending through top sidewall 20*a* of first storage shell 10*a* and holes 60 extending through bottom sidewall 20*c* of second storage shell 10*b* align with one another (e.g., from front to back and from left to right). As illustrated in FIGS. 9 and 10, clips 14 are used to secure adjacent storage shells 10 to one another. Each clip 14 includes a head 82 and two symmetrical legs 84 (i.e., first leg 84*a* and second leg 84*b* or, collectively, a pair of legs). Head 82 defines a substantially planar surface 86 having a larger outer perimeter than holes 60 and may be formed circular, square, or any other suitable shape. In one example, a surface 88 of head 82 opposite substantially planar surface 86 is substantially flat; however, surface 88 may be rounded or otherwise shaped.

Each of legs 84 extends from substantially planar surface 86 of head 82 to a free end 90. In one example, each leg 84 is elongated (e.g., substantially rectangular) and spaced from the other leg 84. More specifically, in one embodiment, outer and opposite surfaces of legs 84 are spaced from each other a distance less than an interior diameter (i.e., interior width) of holes 60 such that legs 84 are configured to fit through holes 60 in storage shells 10. In one example, legs 84 are formed of a slightly flexible and elastomeric material allowing legs 84 to flex in toward one another as generally indicated by arrows 92 in FIG. 10 when inward forces are applied thereto and to elastically return to their initial position when the inward forces are removed. In one embodiment, to limit the flexing of legs 84 toward one another, a bridge member 94 extends substantially perpendicular to and between legs 84. Bridge member 94 extends from legs 84 at points along a middle third of the length of legs 84, for example, substantially half way between substantially planar surface 86 and free ends 90. With bridge member 94 in place, flexing of legs 84 is primarily limited to a portion of each leg 84 extending between bridge member 94 and the corresponding free end 90.

In one example, a protrusion or claw 96 is defined near each free end 90. More specifically, one claw 96 extends from free end 90 of first leg 84*a* away from second leg 84*b*, and one claw 96 extends from free end 90 of second leg 84*b* away from first leg 84*a*. As such, claws 96 extend radially outwardly (i.e., away from one another) from each leg 84. In one embodiment, each claw 96 defines an interface surface 98, which, in one example, is substantially planar, on a portion of each claw 96 nearest and facing substantially planar surface 86 of head 82. In one embodiment, interface surfaces 98 extend substantially parallel to substantially planar surface 86. In one example, a distance $D_2$ is defined between interior surface 44 of bottom sidewall 20*c* of second storage shell 10*b* and interior surface 44 of top sidewall 20*a* of first storage shell 10*a*. A distance $D_3$ is defined between substantially planar surface 86 and interface surface 98 and is slightly larger than distance $D_2$ (the difference between the two distances being slightly exaggerated in FIG. 10 for illustrative clarity as will be apparent to those of skill in the art upon reading this application).

In one embodiment, claw 96 defines an angled surface 100 from a tip of free end 90 toward an outwardly most portion of interface surface 98. As such, angled surface 100 extends radially outwardly and toward head 82. At their closest points, angled surface 100 of first leg 84*a* and angled surface 100 of second leg 84*b* are spaced from one another a distance $D_5$, which is less that a diameter or width $D_4$ of holes 60. At their furthest spaced points, angled surface 100 of first leg 84*a* and angled surface 100 of second leg 84*b* are spaced from one another a distance $D_6$, which is greater than a diameter or width $D_4$ of holes 60. In one embodiment, each clip 14 is formed as a contiguous piece of a single material, for example, injection molded plastic.

When used to secure two storage shells 10 such as first storage shell 10*a* and second storage shell 10*b* to one another, clip 14 is pushed through holes 60 of both storage shells 10*a* and 10*b*. For example, as shown in FIGS. 9 and 10, clip 14 is pushed from interior surface 44 of bottom sidewall 20*c* of second storage shell 10*b* through a corresponding hole 60 formed therein and through a corresponding (i.e., aligned) hole 60 of top sidewall 20*a* of first storage shell 10*a*. More specifically, as clip 14 is pushed into hole 60 of bottom sidewall 20*c* of second storage shell 10*b* in the direction generally indicated by arrow 102, interior surface 44 of that bottom sidewall 20*c* interacts with angled surfaces 100 of clip 14 causing legs 84 of clip 14 to flex toward one another as generally indicated in FIG. 10 by arrows 92. Such flexing of legs 84 allows claw 96 of clip 14 to move through the hole 60 of bottom sidewall 20*c* of second storage shell 10*b*.

Once claw 96 clears hole 60 and track 46 of second storage shell 10*b*, legs 84 flex back to their initial position due to the elastomeric nature of the material used to form clip 14. When clip 14 is continued to move toward first storage shell 10*a* along the direction generally indicated by arrow 102, angled surfaces 100 of clip 14 to interact with track 46 of top sidewall 20*a* of first storage shell 10*a* again causing legs 84 of clip 14 to flex toward one another. Such flexing of legs 84 allows claw 96 of clip 14 to move through the top sidewall 20*a* of first storage shell 10*a*. Once claw 96 clears hole 60 of first storage shell 10*a*, legs 84 flex back to their initial position and claws 96 are positioned adjacent and substantially parallel to interior surface 44. In this position, clip 14 effectively holds first and second storage shells 10*a* and 10*b* together as claw 96 generally prevents clip 14 from moving back through top sidewall 20*a* of first storage shell 10*a* toward second storage shell 10*b* without purposeful user intervention with clip 14. In one embodiment, a clip 14 is similarly positioned between first storage shell 10*a* and second storage shell 10*b* through each of the corners holes 60 of bottom sidewall 20*c* of second storage shell 10*b* and top sidewall 20*a* of first storage shell 10*a*.

In one embodiment, when storage shells 10*a* and 10*b* are coupled to one another, top sidewall 20*a* of first storage shell 10*a* and bottom sidewall 20*c* of second storage shell 10*c* are maintained entirely spaced from one another even between corresponding tracks 46 of storage shells 10*a* and 10*b*. In other words, storage shells 10*a* and 10*b* only contact each other at free ends of flanges 64, for example, at auxiliary legs 74, 76. As such, a length of clip 14 independently extends between top sidewall 20*a* of first storage shell 10*a* and bottom sidewall 20*c* of second storage shell 10*c* entirely unsupported or bordered by any sidewall 20 or other portion of storage shells 10*a* and 10*b*. In one embodiment, the distance of clip 14 that is unsupported is over half the length of clip 14.

When clips 14 are so positioned coupling storage shells 10*a* and 10*b* to one another, tracks 46 provide additional structural stability to storage and organization system 12. Since holes 60 are positioned within grooves 54 defined by each track 46, at least two sides of holes 60 are reinforced by the corresponding adjacent ribs 50 and 52 of track 46, which, prevents or at least decreases any damage to adjacent sidewalls 20 that is caused by clips 14, for example, when clips 14 exert force on sidewalls 20 while holding adjacent storage shells 10 together. In addition, tracks 46 provide extra rigidity to individual sidewalls 20 allowing the sidewalls 20 to maintain their general shape and configuration even when supporting items for storage or use. In this manner, tracks 46 allow thinner sidewalls 20 to be made that still have sufficient rigidity to support any items placed in or on shells 10 for storage, which is of increased importance since sidewalls 20 of adjacent storage shells 10 do not contact or otherwise sit upon or support one another since only flanges 64 of adjacent storage shells 10 directly interact.

Additional storage shells 10 may be similarly coupled to one another using clips 14. Similarly, storage shells 10 may be secured side to side with clips 14 as generally indicated in FIG. 9 with first storage shell 10*a* and third storage shell 10*c*. Clips 14 also allow coupled storage shells 10 to be uncoupled from one another and reconfigured without the use of additional tools. For example, once again referring to FIG. 10, a user may apply a force as indicated by arrows 92 to free ends 90 of clip legs 84 causing free ends 90 to flex inward and to fit within the confines of holes 60. More specifically, while free ends 90 are flexed inward, a user pushes clip 14 toward second storage shell 10*b* causing free ends 90 to move through hole 60 within and through top sidewall 20*a* of first storage shell 10*a*. As such, first storage shell 10*a* is separated from second storage shell 10*b*. Clip 14 can similarly be flexed and moved back through bottom sidewall 20*c* of second storage shell 10*b* to separate clip 14 from second storage shell 10*b*.

Figure 11:
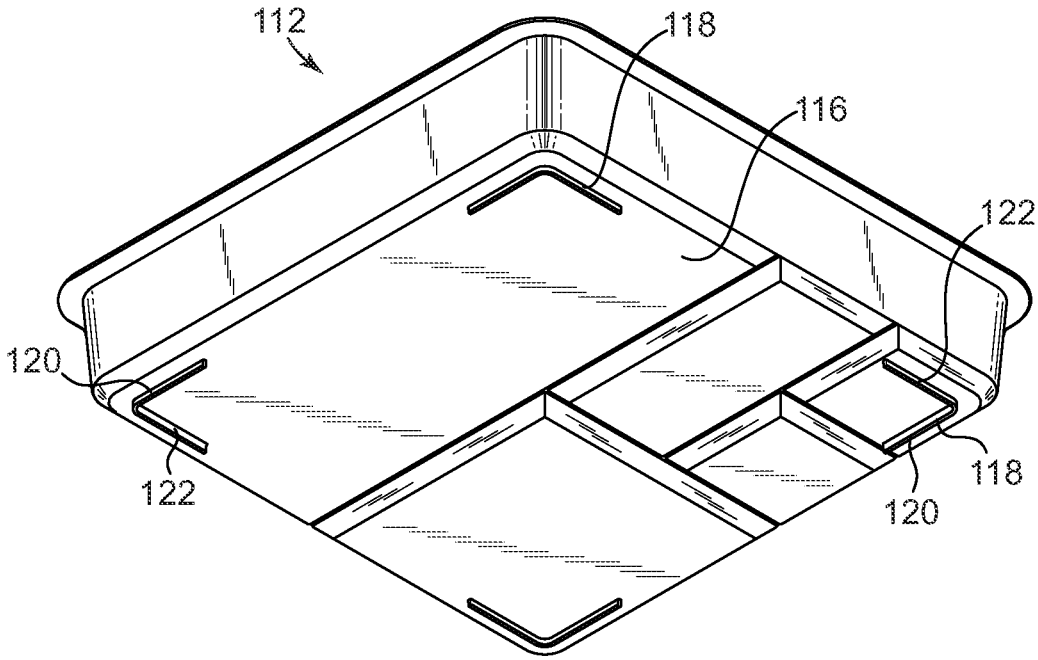
FIG. 11 illustrates a bottom perspective view of a tray for use with the storage shell of FIG. 1, according to one embodiment of the present invention.
Figure 12:
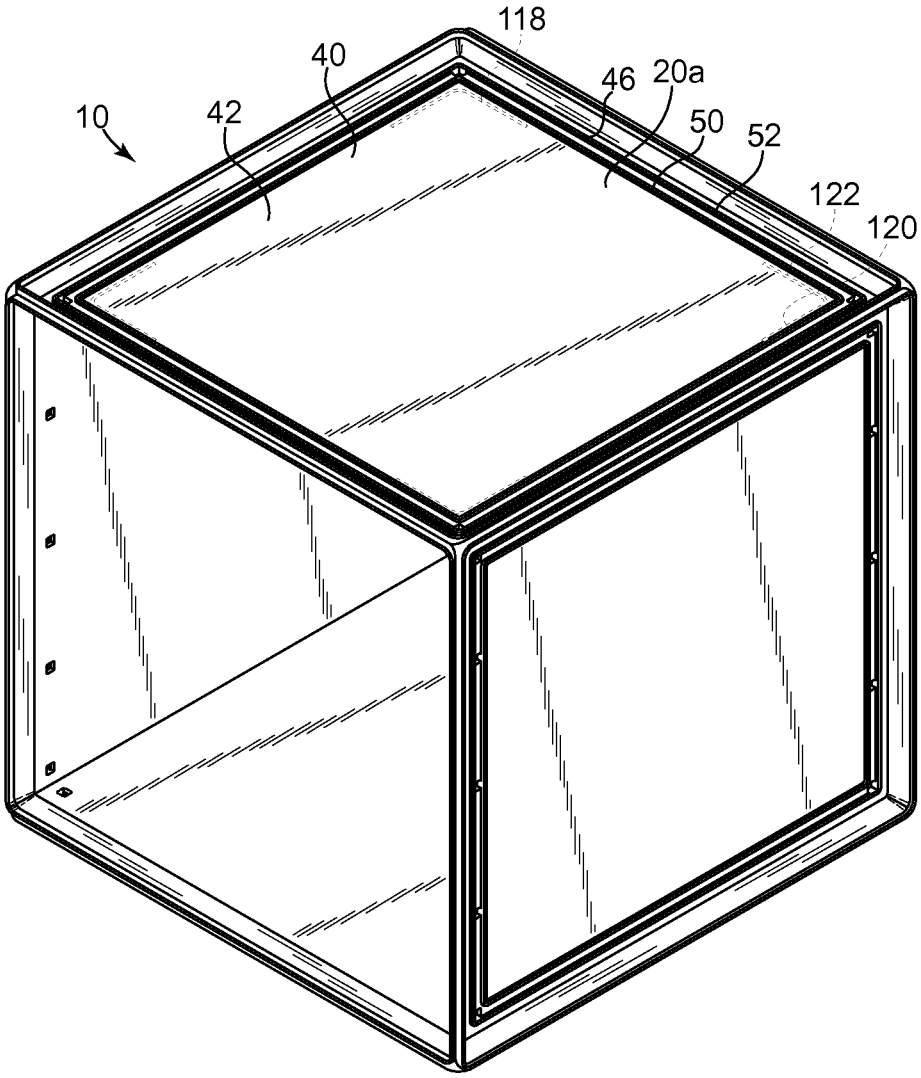
FIG. 12 illustrates a top portion of a storage shell with a portion of the tray of FIG. 11 illustrated in dashed lines, according to one embodiment of the present invention.

Besides facilitating coupling of storage shells 10 to one another, tracks 46 and holes 60 also facilitate coupling of accessory members 110 with storage shells 10. For example, referring to FIGS. 9 and 11, in one embodiment, accessory members 110 of storage and organization system 12 include a box or tray 112 defining one or more cavities 114 for storing or otherwise holding items. Tray 112 includes a bottom wall 116, which is substantially planar and may or may not be continuous. Ribs 118 extend downwardly from bottom wall 116, which, in one example, is substantially square or rectangular, near an outer perimeter thereof. In one example, a separate rib 118 is placed in each corner of bottom wall 116 and is generally L-shaped such that one leg 120 extends substantially perpendicular to another leg 122 of each rib 118. In one embodiment, ribs 118 are connected to one another to collectively define a closed-looped rib.

Ribs 118 are placed such that each leg 120 and 122 extends just inside an outer corner of bottom wall 116 and extends substantially parallel to a side edge of bottom wall 116. When tray 112 is placed on a top sidewall 20*a* of a storage shell 10, such as second storage shell 10*b*, at least one rib 118 is configured to fit within a corner of inner rib 50 of track 46. Where tray 112 is sized to cover substantially all of a top sidewall 20*a*, each rib 118 of tray 112 is configured to fit just inside a different corner of track 46. This interaction generally prevents or at least decreases side-to-side and/or front-to-back movement, especially, inadvertent movement, of tray 112 relative to top sidewall 20*a* of the respective storage shell 10.

As will be apparent to those of skill in the art upon reading this application, trays (not shown) sized differently than tray 112 may be used. For instance, two side-by-side trays may fit on top sidewall 20*a* of a storage shell 10 such that each tray has two ribs that interact with corners of track 46. For example, a first tray has two ribs where each rib interacts with the right side corners of track 46, and a second tray has two opposite ribs that each interact with the left side corners of track 46. Use of other numbers of trays configured to fit within track 46 of a single sidewall 20 is also contemplated.

Figure 13:
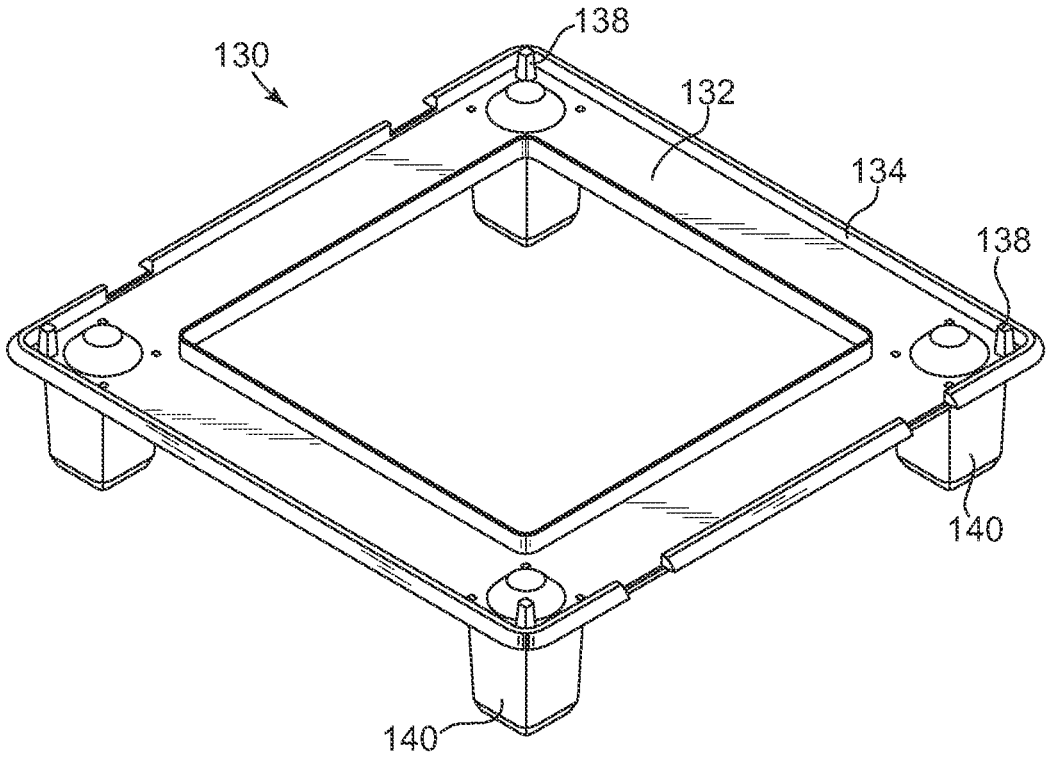
FIG. 13 illustrates a support base for use with the storage shell of FIG. 1, according to one embodiment of the present invention.

Referring to FIGS. 9 and 13, in one embodiment, accessory member(s) 100 include a support base 130. Support base 130 generally includes a substantially planar, primary panel 132 with raised edge 134 extending upwardly and around a perimeter thereof. Protruding pillars 138 also extend from primary panel 132, and each pillar 138 is positioned near and inset from a different corner of primary panel 132. Pillars 138 each extend away from primary panel 132 a distance greater than, for example, at least twice as far as, raised edge 134.

Legs 140 extend from corners of support base 130 in an opposite direction as raised edge 134 to provide height to base 130. Legs 140 may be static risers as illustrated in FIG. 13 or alternatively may incorporate casters or other support members as will be apparent to those of skill in the art upon reading this application.

Support base 130 is configured to interface with bottom sidewall 20*c* of a storage shell 10, for example, first storage shell 10*a* as illustrated in FIG. 9. More specifically, in one embodiment, each hole 60 in bottom sidewall 20*c* is sized, shaped, and positioned to receive a different one of pillars 138. In one embodiment, each pillar 138 is slightly tapered as it extends away from primary panel 132 such that as each pillar 138 is slid into a corresponding hole 60 it becomes tighter within hole 60 and is eventually held in place via friction fit. In one embodiment, raised edge 134 extends from primary panel 132 a similar distance as ribs 50 and 52 extend from substantially planar panels 40 of sidewalls 20. In one example, when support base 130 is coupled with a storage shell 10, raised edge 134 of support base 130 fits around outer rib 52 of track 46. As such, support base 130 is selectively coupled with the corresponding storage shell 10 and holds storage shell 10 above the ground, floor, or other support surface (not shown). Support base 130 is removable from the corresponding storage shell 10 simply by applying a force to move support base 130 away from storage shell 10 of a sufficient magnitude to overcome the friction fit between pillars 138 of support base 130 and holes 60 of shell 10.

Figure 14:
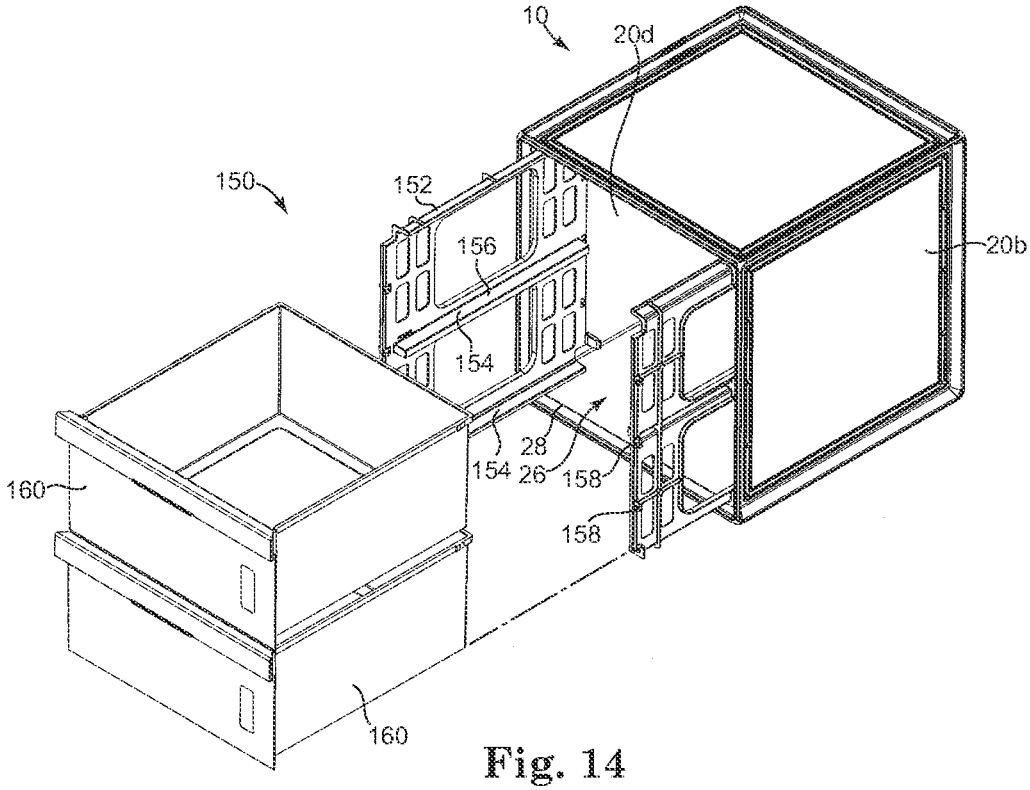
FIG. 14 illustrates the support shell of FIG. 1 with drawer and drawer support accessories, according to one embodiment of the present invention.

In one embodiment, accessory member(s) 100 also include interior members such as drawer unit 150 as illustrated in FIG. 14. Drawer unit 150 is configured to be inserted into compartment 26 of shell 10. In one embodiment, drawer unit 150 provides a pre-assembled and separately purchasable drawer sub-unit specifically configured to fit within a compartment 26 of shell storage 10. Drawer unit 150 is thereby configured to have similar, but slightly smaller, outside dimensions as compared to the inside dimensions of compartment 26 of storage shell 10. More specifically, drawer unit 150 includes vertical support walls 152 defining the outside dimensions of drawer unit 150. Support rails 154 extend inwardly from vertical support walls 152 and define a drawer support surface 156 on an upper portion thereof.

Connection tabs 158 extend from vertical support walls 152, and in one embodiment, are similar to, but not as long as, clip legs 84. Connection tabs 158 are sized, shaped, and positioned to selectively fit within holes 60 of vertical sidewalls 20*b* and 20*d* to selectively couple vertical support walls 152 with storage shell 10 within compartment 26. In one example, connection tabs 158 are only configured to interface with holes 60 of storage shell 10 that are not in respective corners of sidewalls 20 to avoid any conflict between clips 14 and connection tabs 158 (e.g., compare FIG. 9 with FIG. 14). In one embodiment, vertical support walls 152 are substantially eliminated and support rails 154 themselves include connection tabs 158 for selectively coupling support rails 154 to storage shell 10 as will be apparent to those of skill in the art upon reading the application.

Drawer unit 150 additionally includes one or more drawers 160 each configured to be selectively slid into and out of storage shell 10 upon assembly. More specifically, each drawer 160 is configured to be slidably supported on two opposite support rails (i.e., a support rail defined by each vertical support wall 152) such that drawers 160 can be repeatedly slid into and out of compartment 26.

Other accessory members 110, such as shelves, etc., are also contemplated as will be apparent to those of skill in the art upon reading this application and make use of holes 60 and/or track 46 to facilitate selective coupling with storage shells 10.

Figure 15:
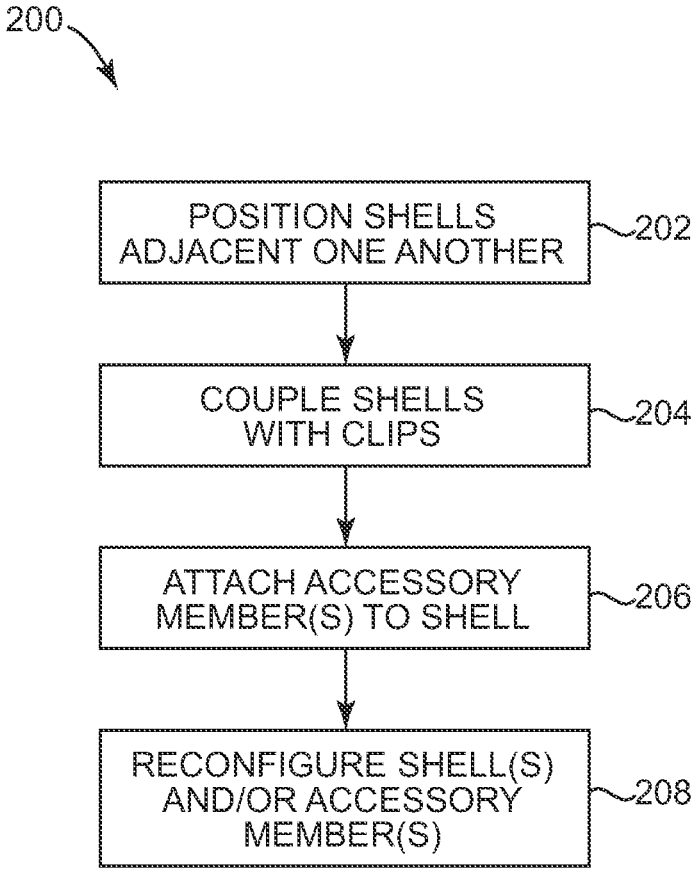
FIG. 15 illustrates a flow chart for a method of assembling a storage and organization system, according to one embodiment of the present invention.

FIG. 15 is a flow chart generally illustrating one embodiment of a method 200 of using storage and organization system 12 as described with respect to FIGS. 1 and 9. At 202, two or more storage shells 10 are positioned adjacent one another. For example, storage shells 10 are stacked or otherwise positioned next to one another. Once storage shells 10 are configured as desired at 202, then at 204, storage shells 10 are coupled to one another with clips 14 as described above. For example, where two storage shells 10 are stacked, clips 14 are positioned to extend through bottom sidewall 20*c* of one storage shell 10 and through top sidewall 20*a* of the other storage shell 10. In one example, where two storage shells 10 are positioned side by side, clips 14 are positioned through a right sidewall 20*b* of one storage shell 10 and through a left sidewall 20*d* of the other storage shell 10.

At 206, accessory member(s) 110 if any, are added to storage and organization system 12. For example, tray 112 may be placed on a storage shell 10 such that ribs 118 of tray 112 interact with track 46, support base 130 may be coupled with a bottom sidewall 20*c* of a storage shell 10, drawer unit 150 may be positioned within compartment 26 and coupled with storage shell 10, and/or any other accessory member(s) 110 may be added to personalize and/or customize the storage and organizational system for a particular purpose or need of the user. If such user purposes or needs ever change, then at 208 the user may reconfigure storage shell(s) 10 and any accessory members 110 to repurpose the storage and organization system in view of the new or changing needs of the user. Operation 208 is facilitated by use of clips 14 and other attachments that are selective and easy to be removed without damaging individual components of the storage and organization system 12 and generally do not require the use of tools.

Figure 16:
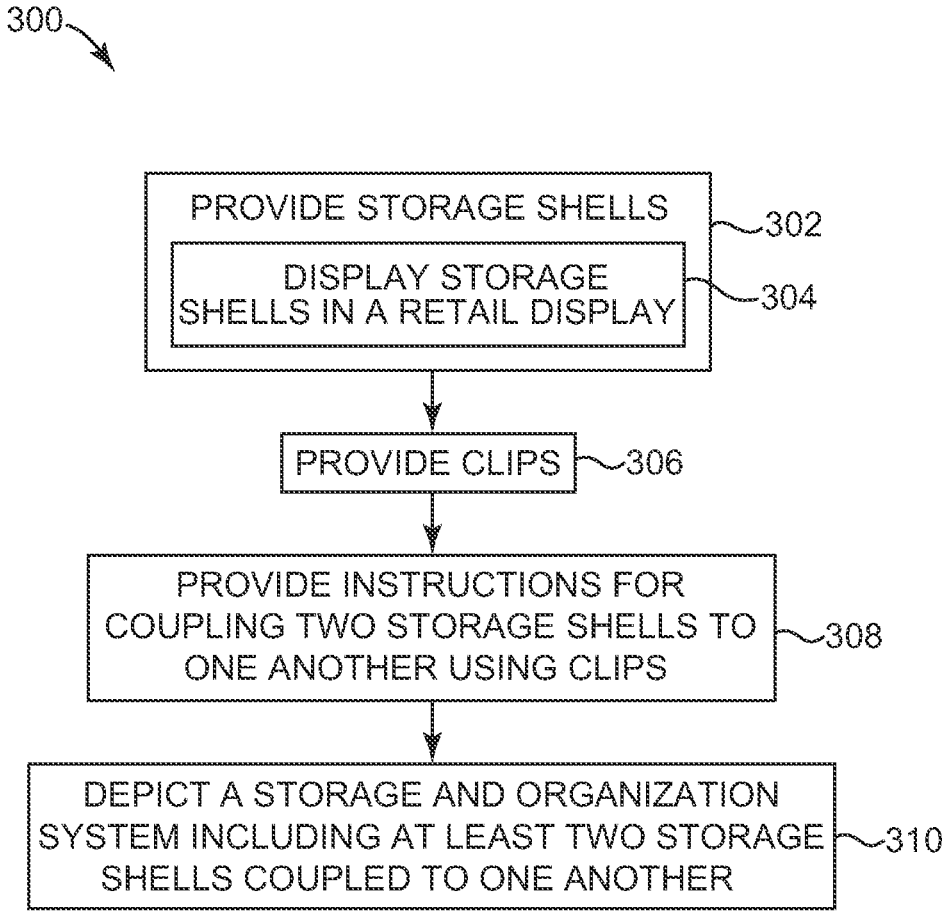
FIG. 16 illustrates a flow chart for a method of providing a storage and organization system, according to one embodiment of the present invention.

FIG. 16 illustrates one embodiment of a method 300 of providing a storage and organization system. For example, at 302, storage shells 10, for example, first storage shell 10*a*, second storage shell 10*b*, third storage shell 10*c*, etc., are provided. In one embodiment, providing storage shells 10 at 302 includes displaying storage shells 10 as part of a retail display viewable by potential consumers at 304. At 306, clips 14, and, in one example, other accessory members 110, are also provided and/or included as part of the retail display. At 308, instructions are provided to consumers instructing consumers regarding how to position and couple two or more storage shells 10 together using clips 308 and without using separate tools. For example, instructions indicate that two storage shells 10 should be placed adjacent to one another such that at least a portion of flanges 64 of each storage shell 10 interact with one another. Instructions further describe placing a clip 14 through a hole 60 in one storage shell 10 through an aligned hole 60 of another storage shell 10, etc. as described in greater detail above.

In one example, at 310, a storage and organization system, for example, storage and organization system 12 (FIG. 9), is depicted to consumers. The depiction provided at 310 not only serves as an example of how two or more storage shells 10 may be used together, but also provides inspiration to potential consumer regarding possible uses of storage shells 10. In one embodiment, by promoting different uses of storage shells 10, depiction promotes sale of storage shells 10 to consumers. In one example, the depiction provided at 310 is provided as part of or near the retail display providing storage shells 10.

It should be understood that "retail display" as used above generally refers to any tangible (e.g., in-store) or intangible (e.g., Internet-based) display of storage shells 10, etc. to potential consumers. Although method 300 is illustrated as a series of operations, in one embodiment, operations 302, 306, 308, and 310 can be performed in any order and/or two or more of operations 302, 306, 308, and 310 can be performed simultaneously as will be apparent to those of skill in the art upon reading this application.

Although the invention has been described to particular embodiments, such embodiments are for illustrative purposes only and should not be considered to limit the invention. Various alternatives and modifications within the scope of the invention in its various embodiments will be apparent to those with ordinary skill in the art upon reading this application.

What is claimed is:

1. A storage shell assembly comprising:

a first shell comprising a first plurality of sidewalls each extending between two others of the first plurality of sidewalls to collectively define a first chamber therebetween, the first plurality of sidewalls including a first sidewall defining:

a first substantially planar panel defining a first exterior surface and a first plurality of holes extending through the first substantially planar panel, wherein each of the first plurality of holes is positioned in a first linear array, and a first raised rib extending outwardly from the first exterior surface of the first substantially planar panel, the first raised rib extending immediately adjacent each of the first plurality of holes in the first linear array, a second shell configured to be positioned adjacent the first shell, the second shell comprising a second plurality of sidewalls each extending between two others of the second plurality of sidewalls to collectively define a second chamber therebetween, the second plurality of sidewalls including a second sidewall defining:

a second substantially planar panel defining a second exterior surface and a second plurality of holes extending through the second substantially planar panel, wherein the second plurality of holes is positioned in a second linear array; and a clip member formed separately from each of the first shell and the second shell, the clip member being configured to removably couple with each of the first shell and the second shell such that when the clip member is coupled with each of the first shell and the second shell, the clip member extends at least partially through each of the one of the first plurality of holes and a corresponding one of the second plurality of holes, interfaces with the first raised rib, and extends substantially unsupported between the first raised rib and the second shell.

2. The storage shell assembly of claim 1, wherein the storage shell is formed as a single contiguous piece of material.

3. The storage shell assembly of claim 1, wherein the clip member defines a head and two opposing legs, the two opposing legs are configured to flex toward one another to allow the two opposing legs to pass through the one of the first plurality of holes in the first substantially planar panel, and wherein the two opposing legs only fit through the one of the first plurality of holes when the two opposing legs are flexed toward one another.

4. The storage shell assembly of claim 1, wherein each of the first plurality of sidewalls is substantially identical to the first sidewall.

5. The storage shell assembly of claim 1, further comprising a support base comprising:

a planar member, support legs extending from one side of the planar member; and pillars each extending from an opposite side of the planar member in an opposite direction as the support legs, wherein each pillar fits within one of the plurality of holes defined by the first sidewall.

6. The storage shell assembly of claim 5, wherein each of the pillars is tapered as it extends away from the planar member.

7. The storage shell assembly of claim 1, wherein the first shell defines a first opening to the first chamber, the first shell further comprises first flanges each radially extending away from the first opening a distance further than the first raised rib extends away from the first substantially planar panel.

8. The storage shell assembly of claim 7, wherein the second storage shell defines a second opening and includes second flanges extending radially outwardly from the second opening of the second storage shell, and the first storage shell and the second storage shell are positioned adjacent one another such that the first flanges of the first storage shell interface with the second flanges of the second storage shell in a manner maintaining the first sidewall of the first storage shell spaced from and substantially parallel to the first sidewall of the second storage shell.

9. The storage shell assembly of claim 8, wherein the clip member is substantially unsupported between the first sidewall of the first storage shell and the first sidewall of the second storage shell for at least half a length of the clip member.

10. The storage shell assembly of claim 9, wherein the clip member comprises:

a head defining a substantially planar surface and an outer diameter, the outer diameter being larger than an outer dimension of one of the plurality of holes of the first storage shell;

a pair of legs extending from the substantially planar surface of the head to define free ends opposite the substantially planar surface, wherein the free ends are configured to flex toward one another into a flexed position when corresponding forces are applied to the free ends and to return to an original position upon removal of the corresponding forces, the free ends define two claws each extending outwardly from a different one of the free ends of the pair of legs, the two claws collectively being wider than the outer dimension of the one of the first plurality of holes of the first storage shell when the clip member is in the original position, and the two claws are collectively narrower than the outer dimension of the one of the first plurality of holes when the clip member is in the flexed position.

11. The storage shell assembly of claim 1, wherein the clip member is one of a plurality of clip members removably coupling with each of the first shell and the second shell, the plurality of clip members maintaining the first sidewall entirely spaced from and extending substantially parallel to the second sidewall.

12. The storage shell assembly of claim 11, wherein:

the first shell further comprises a second raised rib extending outwardly from the first exterior surface of the first substantially planar panel, the second raised rib extends immediately adjacent each of the first plurality of holes in the first linear array opposite the first raised rib, and when the plurality of clip members maintain the first sidewall entirely spaced from and extending substantially parallel to the second sidewall, the first raised rib remains spaced entirely from the second raised rib.

13. A storage and organization system comprising:

a first box comprising:

four first side panels coupled to one another to collectively define a first compartment therebetween and a first opening extending in a plane substantially perpendicular to each of the four first side panels, wherein a first aperture is defined by each of the first side panels, and first flanges each extending away from a different outside perimeter boundary edge of the first opening;

a second box comprising:

four second side panels coupled to one another to collectively define a second compartment therebetween and a second opening extending in a plane substantially perpendicular to each of the four second side panels, wherein a second aperture is defined by each of the second side panels, and second flanges each extending away from a different outside perimeter boundary edge of the second opening, wherein first and second boxes are positioned adjacent one another such that at least one of the first flanges contacts at least one of the second flanges, one of the first side panels is positioned spaced from and extends generally parallel to one of the second side panels to define a cavity therebetween; and a connecting device extending through the first aperture and the second aperture to couple the first box to the second box, wherein:

the connecting device independently extends through the cavity defined between the one of the first side panels and the one of the second side panels, the connecting device is one of a plurality of substantially identical connecting devices extending between the one of the first side panels and the one of the second side panels, and the plurality of substantially identical connecting devices are the only items extending between and contacting the one of the first side panels and the one of the second side panels within the cavity.

14. The storage and organization system of claim 13, wherein each of the first flanges radially extends outwardly away from a center of the first box, and each of the second flanges radially extends outwardly away from a center of the second box.

15. The storage and organization system of claim 13, wherein the first side panels each include a rib extending outwardly from a corresponding one of the first side panels immediately adjacent the first aperture.

16. The storage and organization system of claim 13, wherein the connecting device comprises:

a head having an outer dimension larger than the first aperture and defining a substantially planar surface;

a pair of legs extending away from the substantially planar surface of the head, the pair of legs extending spaced from and substantially parallel to one another and extending substantially perpendicularly relative the substantially planar surface of the head, wherein the pair of legs are configured to flex toward one another to allow the pair of legs to pass through the first aperture and the second aperture, and wherein the pair of legs only fit through the first aperture and the second aperture when the pair of legs are flexed toward one another.

17. The storage and organization system of claim 13, wherein one of the first side panels faces the second box, the one of the first side panels is substantially planar, defines a exterior surface, and the first aperture is one of a plurality of first apertures defined by and extending through the one of the first side panels and is positioned near an outside perimeter of the one of the first side panels, and the first box further comprises:

a first rib coupled to and extending away from the one of the first side panels, wherein the first rib borders each the plurality of first apertures defined by the one of the first side panels.

* * * * *